US010648315B2

(12) United States Patent
Couturier et al.

(10) Patent No.: US 10,648,315 B2
(45) Date of Patent: May 12, 2020

(54) AUTOMATED WELL PRESSURE CONTROL AND GAS HANDLING SYSTEM AND METHOD

(71) Applicant: Schlumberger Technology Corporation, Sugar Land, TX (US)

(72) Inventors: Yawan Couturier, Houston, TX (US); Bastiaan Liezenberg, Houston, TX (US); Glenn Johnson, Houston, TX (US); Vikas Rakhunde, Houston, TX (US); Jesse Hardt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/197,449

(22) Filed: Jun. 29, 2016

(65) Prior Publication Data

US 2018/0003023 A1 Jan. 4, 2018

(51) Int. Cl.

| | |
|---|---|
| ***E21B 17/01*** | (2006.01) |
| ***E21B 21/08*** | (2006.01) |
| ***E21B 33/064*** | (2006.01) |
| ***E21B 44/00*** | (2006.01) |
| ***E21B 15/02*** | (2006.01) |

(Continued)

(52) U.S. Cl.

CPC ..... *E21B 44/00* (2013.01); *E21B 15/02* (2013.01); *E21B 21/001* (2013.01); *E21B 21/08* (2013.01); *E21B 21/106* (2013.01); *E21B 33/064* (2013.01); *E21B 34/06* (2013.01); *E21B 47/06* (2013.01); *E21B 17/01* (2013.01)

(58) Field of Classification Search

CPC ..... E21B 15/02; E21B 17/01; E21B 21/001; E21B 21/08; E21B 21/106; E21B 33/064; E21B 44/00; E21B 47/06

See application file for complete search history.

(56) References Cited

U.S. PATENT DOCUMENTS 5,168,932 A * 12/1992 Worrall ..... E21B 21/001 166/336
6,904,981 B2 * 6/2005 van Riet ..... E21B 21/08 166/265

(Continued)

FOREIGN PATENT DOCUMENTS

WO 2015/190932 A1 12/2015

OTHER PUBLICATIONS

International Search Report and Written Opinion for the equivalent International patent application PCT/US2017/039607 dated Oct. 27, 2017.

(Continued)

*Primary Examiner* — Matthew R Buck
(74) *Attorney, Agent, or Firm* — Jeffrey D. Frantz

(57) ABSTRACT

A method includes pumping fluid into a drill string extending through a riser into a well. A managed pressure drilling system is operated to maintain a selected fluid pressure in the well between the well and the drill string. A fluid influx into the well or a fluid loss into a formation traversed by the well is detected using measurements of fluid pressure in the well and fluid flow into and out of the well. The method includes automatically abating the fluid influx by closing an annular blowout preventer disposed in the riser or abating the fluid loss by operating the annular blowout preventer and pumping a sacrificial fluid into the drill string.

18 Claims, 5 Drawing Sheets

(51) Int. Cl.

| | |
|---|---|
| ***E21B 21/00*** | (2006.01) |
| ***E21B 21/10*** | (2006.01) |
| ***E21B 34/06*** | (2006.01) |
| ***E21B 47/06*** | (2012.01) |

(56) References Cited

U.S. PATENT DOCUMENTS

| | | | | |
|---|---|---|---|---|
| 7,264,058 | B2 * | 9/2007 | Fossli | E21B 21/001 166/34 |
| 7,562,723 | B2 * | 7/2009 | Reitsma | E21B 21/08 175/217 |
| 7,650,950 | B2 * | 1/2010 | Leuchtenberg | E21B 21/08 166/53 |
| 8,413,724 | B2 * | 4/2013 | Carbaugh | E21B 17/085 166/344 |
| 8,517,111 | B2 * | 8/2013 | Mix | E21B 21/08 166/250.01 |
| 8,567,525 | B2 * | 10/2013 | Reitsma | E21B 21/08 166/250.01 |
| 9,080,427 | B2 * | 7/2015 | Ghasripoor | E21B 33/085 |
| 9,109,420 | B2 * | 8/2015 | Tindle | E21B 33/035 |
| 9,222,320 | B2 * | 12/2015 | Varpe | E21B 21/106 |
| 9,506,305 | B2 * | 11/2016 | Leuchtenberg | E21B 21/001 |
| 2006/0037781 | A1 * | 2/2006 | Leuchtenberg | E21B 21/08 175/25 |
| 2007/0045006 | A1 * | 3/2007 | Krueger | E21B 21/08 175/25 |
| 2008/0060846 | A1 * | 3/2008 | Belcher | E21B 17/042 175/25 |
| 2011/0139464 | A1 * | 6/2011 | Henderson | E21B 21/01 166/370 |
| 2011/0290494 | A1 | 12/2011 | Cohen | |
| 2012/0037361 | A1 | 2/2012 | Santos et al. | |
| 2012/0241163 | A1 * | 9/2012 | Reitsma | E21B 19/09 166/355 |
| 2015/0068758 | A1 * | 3/2015 | Leuchtenberg | E21B 21/08 166/336 |
| 2015/0083429 | A1 * | 3/2015 | Reitsma | E21B 21/06 166/335 |
| 2016/0230492 | A1 * | 8/2016 | Boulanger | E21B 33/035 |
| 2018/0245411 | A1 * | 8/2018 | Piccolo | E21B 33/0355 |
| 2019/0145198 | A1 * | 5/2019 | Fossli | E21B 47/042 166/335 |

OTHER PUBLICATIONS

International Preliminary Report on Patentability for the equivalent International patent application PCT/US2017/039607 dated Jan. 10, 2019.

* cited by examiner

AUTOMATED WELL PRESSURE CONTROL AND GAS HANDLING SYSTEM AND METHOD

BACKGROUND

This disclosure relates to the field of pressure control of wells drilled through subsurface earthen formation. More specifically, the present disclosure relates to maintaining wellbore pressure in the event of certain drilling conditions, such as drilling fluid lost to an exposed subsurface formation and the influx of gas into the well from a formation.

U.S. Pat. No. 7,562,723 shows one example embodiment of a "managed pressure drilling" control system. The system shown in the '723 patent may be used to maintain a selected pressure in a wellbore while drilling fluid pumps (rig mud pumps) are operating and while such pumps are switched off for purposes such as adding or removing a segment ("joint" of "stand") of a drill string. The system shown in the '723 patent comprises logic operable to detect influx of fluid into the well from a subsurface formation as well as loss of fluid from the well into a subsurface formation. The system shown in the '723 patent may be used with land-based drilling as well as marine drilling (i.e., drilling subsurface formations below the bottom of a body of water).

U.S. Pat. No. 8,413,724 issued to Carbaugh et al. describes a "riser gas handler." In the event of influx of gas into a well during marine drilling, where a "riser" connects a subsea well control apparatus to a drilling platform on the water surface, the gas expands in volume as it travels upwardly through the liquid column in the riser. As the gas expands in volume, the hydrostatic pressure exerted by the fluid column in the riser is reduced, and the pressure in the well may correspondingly increase. The pressure increase in the riser may at some point exceed the pressure bearing capacity of the riser. The device shown in the '724 patent is intended to divert fluid in the riser that contains gas to flow lines external to the riser. Such flow lines may have a pressure capacity much greater than that of the riser, thus enabling the gas to be removed from the well using known procedures to stop influx of fluid into a well from a subsurface formation.

Because subsurface formation fluid pressures can change substantially and unpredictably, it is desirable to automate systems such as those described above in the Reitsma and Carbaugh et al. patents. More specifically, such automation may be applicable to and coordinated with both such systems as well as with a well pressure control apparatus (blowout preventer—"BOP") disposed proximate the water bottom and connected to the base of the riser.

DETAILED DESCRIPTION

Figure 1:
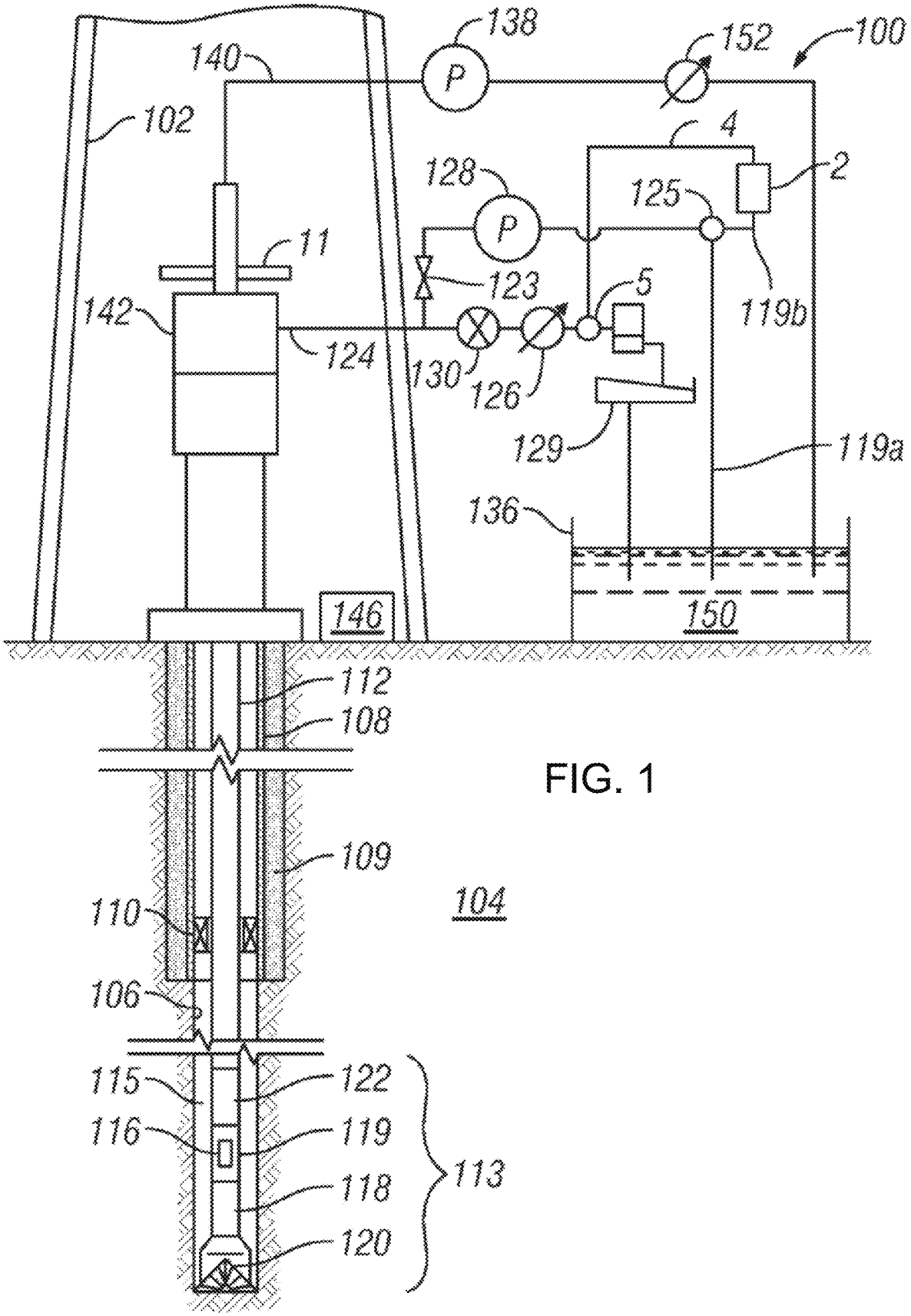
FIG. 1 shows an example of a managed pressure control drilling system.
Figure 2:
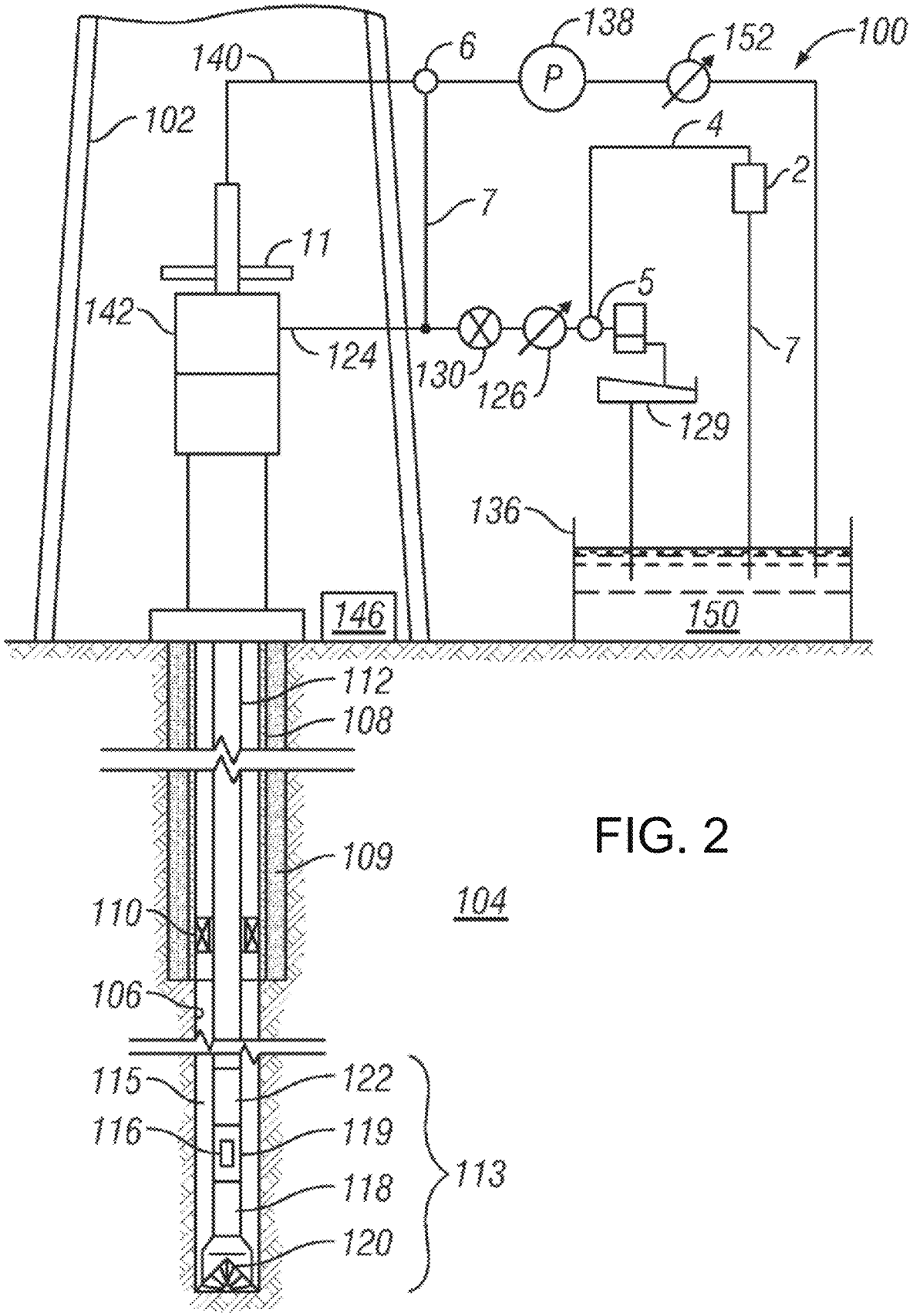
FIG. 2 shows an example of a different embodiment of a managed pressure control drilling system.

FIG. 1 is a plan view showing a drilling system, such as a land-based drilling system, having an embodiment of a managed pressure system that can be used with methods and apparatus according to the present disclosure. The illustration in FIG. 1 and in FIG. 2 are to show functional elements of a managed pressure drilling control system. In methods according to the present disclosure, and as will be shown in FIG. 3, such methods may be used with marine drilling systems with equal effect as with land based drilling systems. The drilling system 100 in FIG. 1 is shown including a drilling rig 102 that is used to support drilling operations. Many of the components used on the drilling rig 102, such as the kelly, power tongs, slips, draw works and other equipment are not shown separately in the Figures for clarity of the illustration. The rig 102 is used to support a drill string 112 used for drilling a well through subsurface formations such as shown as formation 104. The well 106 as shown in FIG. 1 may have been partially drilled, and a protective pipe or casing 108 set and cemented 109 into place in part of the drilled portion of the well 106. A casing shutoff mechanism, or downhole deployment valve, 110 may be installed in the casing 108 to optionally shut off a well annulus 115 and effectively act as a valve to shut off the open hole section of the well 106 (the portion of the well 106 below the bottom of the casing 108) if a drill bit 120 (at the bottom of the drill string 112) is located above the downhole deployment valve 110.

The drill string 112 supports a bottom hole assembly (BHA) 113 that may include the drill bit 120, a mud motor 118, a measurement and/or logging-while-drilling (MWD/LWD) sensor suite 119 that may comprise a pressure transducer 116 to determine the annular pressure in the well 106. The drill string 112 may include a check valve (not shown) to prevent backflow of fluid from the annulus 115 into the interior of the drill string 112. The MWD/LWD suite 119 may comprise a telemetry package 122 that is used to transmit pressure data, MWD/LWD sensor data, as well as drilling information to be received at the Earth's surface in the form of modulation of the flow rate and/or pressure of drilling fluid being pumped through the interior of the drill string 112. While FIG. 1 illustrates a BHA utilizing a mud pressure modulation telemetry system, it will be appreciated that other telemetry systems, such as radio frequency (RF), electromagnetic (EM) or drill string transmission systems may be used with the present invention.

The drilling process may use a drilling fluid 150, which may be stored in a reservoir 136. The reservoir 136 is in fluid communication with one or more rig mud pumps 138 which pump the drilling fluid 150 through a conduit 140. The conduit 140 is connected to the uppermost segment or "joint" of the drill string 112. The uppermost segment of the drill string may pass through a rotating control head or rotating control device (RCD) 142. The RCD 142 internally urges spherically shaped elastomeric sealing elements to rotate upwardly, closing around the drill string 112 and isolating the fluid pressure in the annulus 115, but still enabling drill string rotation and longitudinal motion. The drilling fluid 150 is pumped down through an interior passage in the drill string 112 and the BHA 113 and exits through nozzles or jets in the drill bit 120, whereupon the drilling fluid 150 circulates drill cuttings away from the drill bit 120 and returns the cuttings upwardly through the annulus 115 between the drill string 112 and the well 106 and through the annular space formed between the casing 108 (or riser as will be explained with reference to FIG. 3) and the drill string 112. The drilling fluid 150 ultimately returns to the surface and passes through a fluid outlet of the RCD 142, through a conduit 124 and various surge tanks and telemetry receiver systems (not shown separately).

Thereafter the drilling fluid 150 may proceed to what is generally referred to herein as a backpressure system 131. The drilling fluid 150 enters the backpressure system 131 and may flow through a flow meter 126. The flow meter 126 may be a mass-balance type or other of sufficiently high-resolution to meter the drilling fluid 150 flow out of the well 106. Using measurements from an inlet flowmeter 152 disposed between the rig mud pumps 138 and the drill string 112, which flow meter 152 may also be a mass-balance type or may be a Coriolis-type flow meter, a system operator will be able to determine how much drilling fluid 150 has been pumped into the well 106 through the drill string 112. The use of a pump stroke counter may also be used in place of the inlet flowmeter 152. Typically the amount of drilling fluid 150 pumped into the well 106 and returned from the well 106 are essentially the same in steady-state conditions when compensated for additional volume of the well 106 that is drilled. In compensating for transient effects and the additional volume of the well 106 being drilled and based on differences between the amount of drilling fluid 150 pumped into the well 106 and drilling fluid 150 returned from the well 106, the system operator is be able to determine whether drilling fluid 150 is being lost to the formation 104, which may indicate that formation fracturing or breakdown has occurred, i.e., a significant negative fluid differential. Likewise, a significant positive differential would be indicative of formation fluid entering into the well 106 from the subsurface formations 104.

The returning drilling fluid 150 may proceed to a wear resistant, controllable orifice choke 130. It will be appreciated that there exists chokes designed to operate in an environment where the drilling fluid 150 contains substantial drill cuttings and other solids. The controllable orifice choke 130 is preferably one such type and is further capable of operating at variable pressures, variable openings or apertures, and through multiple duty cycles. The drilling fluid 150 exits the controllable orifice choke 130 and flows through a first valve arrangement 5. The drilling fluid 150 can then be processed by an optional degasser 1 or directly to a series of filters and shale shakers 129, designed to remove contaminants, including drill cuttings, from the drilling fluid 150. The drilling fluid 150 is then returned to the reservoir 136. A flow loop 119A, is provided in advance of a valve arrangement 125 for conducting drilling fluid 150 directly to the inlet of a backpressure pump 128. In other embodiments, the backpressure pump 128 inlet may be provided with fluid from the reservoir 136 through a conduit 119B, which is in fluid communication with a trip tank 2. The trip tank 2 may be used on a drilling rig to monitor drilling fluid gains and losses during drill string "tripping" operations (i.e., withdrawing and inserting the full drill string 112 or substantial subset thereof from the well 106). In the present example embodiments, the trip tank 2 functionality may be maintained. A second valve arrangement 125 may be used to select flow loop 119A, conduit 119B or to isolate the backpressure system. While the backpressure pump 128 is capable of utilizing returned drilling fluid 150 to create a backpressure by selection of flow loop 119A, it will be appreciated that the returned drilling fluid 150 could have contaminants that would not have been removed by the shale shakers 129. In such case, the wear on backpressure pump 128 may be increased. Therefore, it may be preferable for the drilling fluid supply for the backpressure pump 128 to be from conduit 119B to provide reconditioned drilling fluid to the inlet of the backpressure pump 128.

In operation, the second valve arrangement 125 may be operated to select either flow loop 119A or conduit 119B, and the backpressure pump 128 is then engaged to ensure sufficient fluid flow passes through the upstream side of the controllable orifice choke 130 to be able to maintain a selected fluid pressure in the annulus 115, even when there is no drilling fluid 150 flow from the annulus 115. In the present embodiment, the backpressure pump 128 may be capable of providing up to approximately 2200 psi (15168.5 kPa) of pressure; though higher pressure capability pumps may be selected at the discretion of the system designer. It will be appreciated that the pump 128 would be positioned in any manner such that it is ultimately in fluid communication with the annulus 115, the annulus being the discharge conduit of the well.

FIG. 2 shows a different embodiment of a managed pressure drilling system. In the present embodiment the backpressure pump (128 in FIG. 1) is not required to maintain sufficient flow through the controllable orifice choke 130 when the flow through the drill string 112 needs to be shut off for any reason. In the present embodiment, a third valve arrangement 6 is placed downstream of the drilling rig mud pumps 138 in conduit 140. The third valve arrangement 6 allows drilling fluid 150 from the rig mud pumps 138 to be partially or completely diverted from conduit 140 to conduit 7, thus diverting flow from the rig mud pumps 138 that would otherwise enter the interior passage of the drill string 112. By maintaining operation of the rig mud pumps 138 and diverting the pumps' 138 output to the annulus 115, sufficient flow through the controllable orifice choke 130 is provided to maintain annulus 115 pressure.

Figure 3:
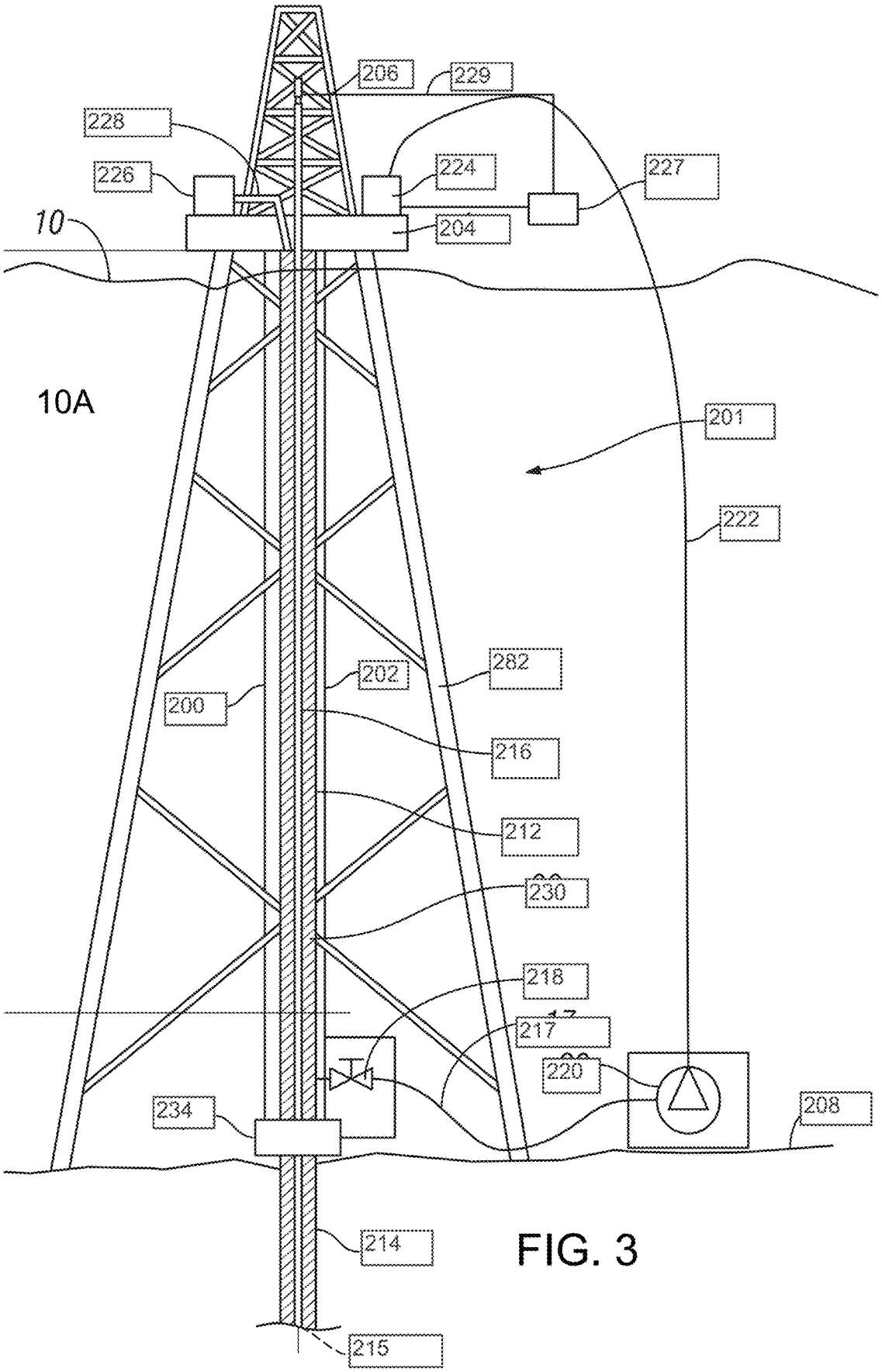
FIG. 3 shows an example of a marine well drilling system that uses a riser to connect a subsea BOP to a drilling platform on the water surface.

FIG. 3 shows an example marine "mud lift" drilling system using a drilling fluid ("mud") return pump when drilling from a drilling unit 201 comprising a derrick 206 above the surface 10 of a body of water 10A. In construction of a sub-bottom borehole using the system in FIG. 3, a conductor pipe may first be driven into or jetted into formations below the water bottom 208. When drilling a well 215 from the drilling system, drilling fluid (150 in FIG. 1) is pumped through a drill string 216 down to a drilling tool, usually including a drill bit (see 120 in FIG. 1). The drilling fluid (150 in FIG. 1) serves several purposes as explained with reference to FIG. 1, one of which is to transport drill cuttings out of the well 215. The drilling fluid (150 in FIG. 1) flows back through an annular space ("annulus") 230 between the drill string 216 and the well wall and/or the liner or surface casing 214. The annulus 230 is in fluid communication with a drilling riser 212 at a subsea wellhead 234 proximate the water bottom 208. The riser 212 may extend to the drilling unit 201, where the drilling fluid (150 in FIG. 1) is treated and conditioned before being pumped back down the drill string 216 into the well 215. In many cases, the drilling fluid in the drilling riser 212 and the annulus 230 will result in a head of pressure in the borehole 215 that is undesirable.

By placing a pump 220 in fluid communication with the interior of the liner 214 near the water bottom 208, or making a similar fluid connection to the interior of the drilling riser 212 at a selected elevation, which may be above the water bottom 208, the returning drilling fluid may be pumped out of the annulus 230 and up to the drilling unit 201. The annular volume in the riser 212 above the drilling fluid level may be filled with a riser fluid that is of a different composition than the drilling fluid.

The drilling fluid pressure at the water bottom 208 may be controlled from the drilling unit 201 by selecting the inlet pressure to the pump 220. Inlet pressure to the pump 220 may be selected by controlling an operating rate of the pump, for example and without limitation, controlling a rotation rate of an impeller of a centrifugal pump or controlling a shaft rotation rate of a positive displacement pump.

In order to prevent the drilling fluid pressure from exceeding an acceptable level (e.g., in the case of a pipe trip), the drilling riser 12 may be provided with a dump valve. A dump valve of this type may be set to open at a particular predetermined pressure for outflow of drilling fluid to the body of water (10A in FIG. 3).

The following describes a non-limiting example of a method and device illustrated in the accompanying drawings, in which, as noted above, FIG. 1 is a schematic view of a fixed drilling rig provided with a pump for the returning drilling fluid, the pump being coupled to the riser section near the seabed and the riser section or portion thereof being filled with a fluid of a different density than that of the drilling fluid.

Reference number 201 denotes a drilling unit comprising a support structure 202, a deck 204 and a derrick 206. The support structure 202 is placed on the water bottom 208 (or the support structure 202 may be affixed to flotation devices as is well known in the art) and projects above the surface 10 of the water. The riser section of the surface casing or liner 214 extends from the water bottom 208 up to the deck 204, while the liner 214 extends further down into the well 125. The riser 212 may be provided with required well head valves, such as a subsea blowout preventer assembly ("BOP") 234. The BOP 234 may include various devices known in the art to close the borehole 15 hydraulically when the drill string 216 is in the well 215, or when there is no drill string present.

The drill string 216 projects from the deck 204 and down through the liner 214. A first pump pipe 217 in some embodiments may be coupled to the riser section 212 near the water bottom 208 via a valve 218 and the opposite end portion of the pump pipe 217 is coupled to a pump 220 placed near the seabed 208. A second pump pipe 222 extends from the pump 220 to a collection tank 224 for drilling fluid on the deck 204.

A tank 226 for a riser fluid communicates with the riser 212 via a connecting pipe 228 at the deck 204. The connecting pipe 28 may have a volume flow meter (not shown). In some embodiments, the density of the riser fluid is less than that of the drilling fluid. The riser fluid may be a gas in which case the tank 226 and connecting pipe 228 can be omitted.

The power supply to the pump 220 may be via an electrical or hydraulic cable (not shown) from the drilling unit 201. The pump 220 may be electrically driven, or may be driven hydraulically by means of oil that is circulated back to the drilling unit 1 or by means of water that is dumped in the sea from the pump 220 power fluid discharge. The pressure at the inlet to the pump 20 is selected from the drilling unit 201.

The drilling fluid is pumped down through the drill string 216 in a manner that is known in the art, for example, using a mud pump 227 which lifts drilling fluid from a storage tank 224 and discharges drilling fluid ("mud") under pressure to the interior of the drill string 216. The drilling fluid may be returned to the deck 4 through an annulus 30 between the liner or casing 214 (and the riser 212) and the drill string 216 through a return line 229. When the pump 220 is started, the drilling fluid is returned from the annulus 230 via the pump 220 to the storage tank 224 on the deck 204. Using such a system it is possible to obtain a significant reduction in the pressure of the drilling fluid in the well 215 and consequently a higher mud density may be used creating a different pressure gradient.

The riser 212 may include auxiliary fluid lines 200, 202 that may be in selective hydraulic communication with the borehole 15 below the wellhead and BOP 234. Such lines may be known by names such as "choke line", "booster line", "kill line", etc., depending on the use of the individual line 200, 202.

In order to prevent the drilling fluid pressure from exceeding an acceptable level (e.g., in the case of gas influx into the well), the drilling riser 212 may be provided with a gas handler. An example embodiment of a gas handler is described in U.S. Pat. No. 8,413,724 issued to Carbaugh et al.

While the example embodiment shown in FIG. 3 is described in terms of using a pump (220) to lift drilling fluid from proximate the base of the riser 212 to the drilling unit 201, in other embodiments, such "subsea mudlift pump" and its ancillary components may be omitted entirely. The description of the components shown FIG. 3 is only meant to provide an example of a marine drilling system using a riser to connect the subsea wellhead 234 to the drilling unit 201. Furthermore, although the various embodiments shown in FIGS. 1, 2 and 3 have the RCD (142 in FIG. 1) proximate the surface, in other embodiments, the RCD may be disposed at any selected position along the riser 212. As will be explained with reference to FIG. 4, in some embodiments, the RCD may be disposed on top of the subsea wellhead.

Figure 4:
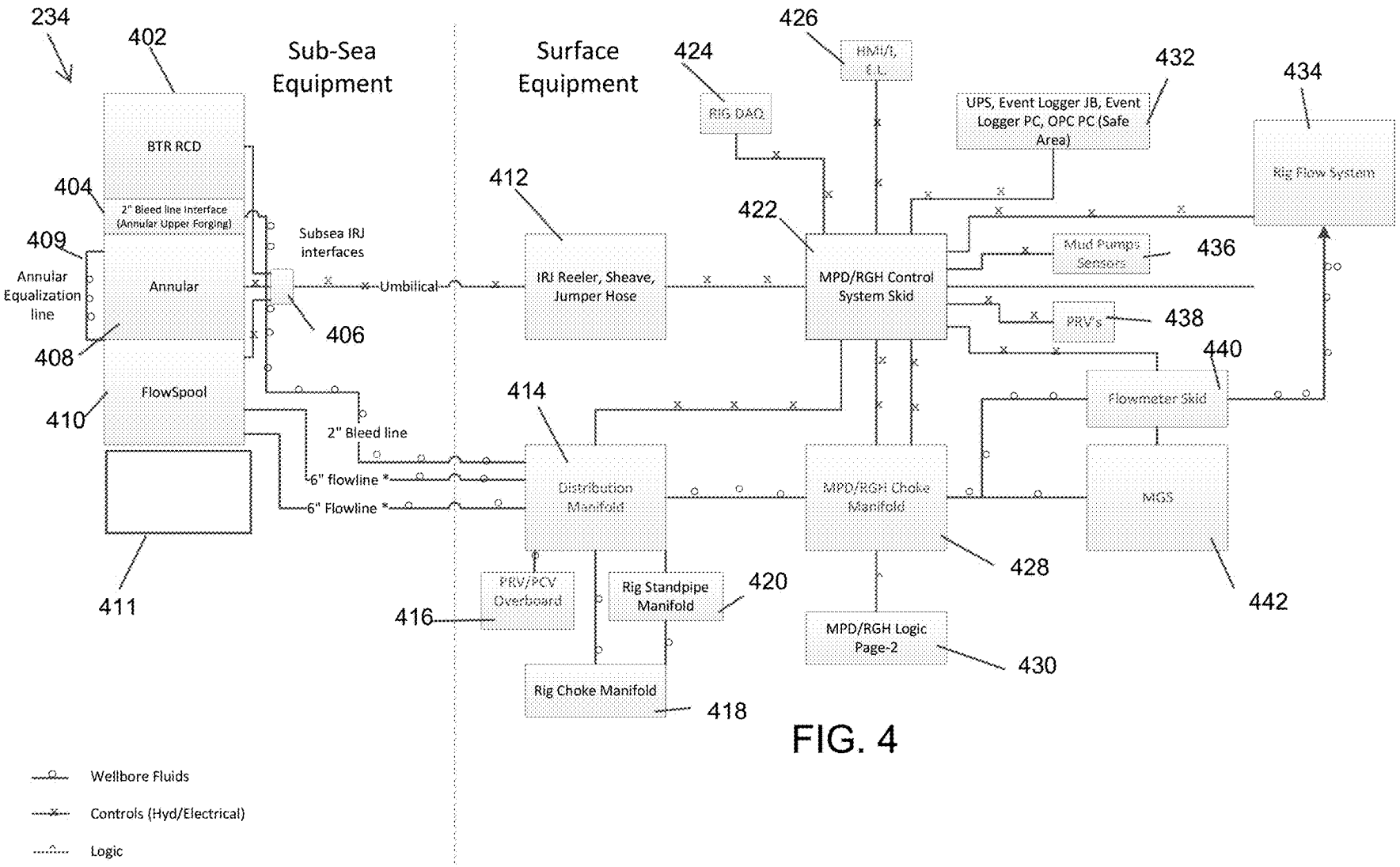
FIG. 4 shows a schematic diagram of fluid flow and well fluid pressure control devices that may be used in accordance with the present disclosure.

FIG. 4 shows a schematic diagram of a managed pressure control system with integrated riser gas handling apparatus. Components corresponding to the subsea wellhead (234 in FIG. 3) may comprise a flow spool 410 coupled to the upper end of the BOP and wellhead 234. An annular BOP 408, which in some embodiments may be a riser gas handler, may be disposed above the flow spool 410. A non-limiting example embodiment of a riser gas handler is described in U.S. Pat. No. 8,143,724 issued to Carbaugh et al. The present example annular BOP 408 may comprise a bleed line interface 404 at the upper end of the annular BOP 408. The annular BOP 408 may further comprise a pressure equalization line 409 that makes selective hydraulic connection between an annular space above the annular BOP 408 and below the annular BOP 408. A BOP stack 411 of any type known in the art for marine well drilling and placement proximate the water bottom may be disposed below the annular BOP 408 and connected to the well head (see 204 in FIG. 3). An interface 406 provides selective connection between a control system (described below) at the surface and the foregoing described components of the subsea wellhead 234.

A riser gas handling/managed pressure drilling control system skid ("control skid") 422 may be disposed on the drilling platform (204 in FIG. 3) and comprise electrical, hydraulic and/or pneumatic controls to selectively operate the above described components of the wellhead and BOP 234. The control skid 422 may accept data input from a rig data acquisition system (DAQ) 424, including, for example and without limitation data such as mud pump pressure, drilling mud flow rate, drill string rotary speed, and imputed amount of axial force on the drill bit (120 in FIG. 1). An event logger 432 may record occurrence of well pressure control events that require operation of one or more of the components shown in FIG. 4 to alleviate excessive well fluid pressure and/or loss of fluid in the well to an exposed subsurface formation. Hose and/or cable connection between the control skid 422 and the interface 406 may use a reel 412 to avoid having excessive slack hose and/or cable disposed between the drilling unit (201 in FIG. 3) and the subsea wellhead 234.

Fluid flow from below and above the components of the subsea wellhead 234 may be communicated through flow lines (in some embodiments clamped onto the exterior of the riser (212 in FIG. 3) to a distribution manifold 414. Operation of various valves to direct and control fluid flow in the distribution manifold 414 may be controlled by operating control devices (not shown separately) in the control system skid 422.

A pressure relief valve or pressure control valve 416 may be in fluid communication with the distribution manifold 414. In the event of excessive pressure in any part of the distribution manifold, the pressure relief valve 416 may open to vent the excess pressure. Output of the rig mud pumps may be directed to a standpipe manifold 420 in fluid communication with the distribution manifold. A choke manifold 418 having one or more chokes, including in some embodiments controllable orifice chokes may be in fluid communication between the standpipe manifold 420 and the distribution manifold 414, for example, to implement a backpressure system as described with reference to FIG. 2.

A managed pressure drilling/riser gas handling choke (MPD/RGH) manifold 422 may be in fluid communication with the distribution manifold 414 to implement managed pressure drilling or riser gas abatement as drilling conditions may require. The MPD/RGH manifold 422 may also have a PRV 438 in fluid communication therewith to vent fluid in the event pressure in the MPD/RGH manifold 428 exceeds a safe amount.

Drilling fluid return processing components may comprise a rig flow system 434, a flowmeter 440 and mud gas separator 442.

Operating logic 430, which may be stored in a non-transitory computer-readable storage medium may be used to cause a processor, which may be disposed in the control system skid 422, to implement drilling fluid pressure and flow control as will now be explained with reference to FIG. 5.

Figure 5:
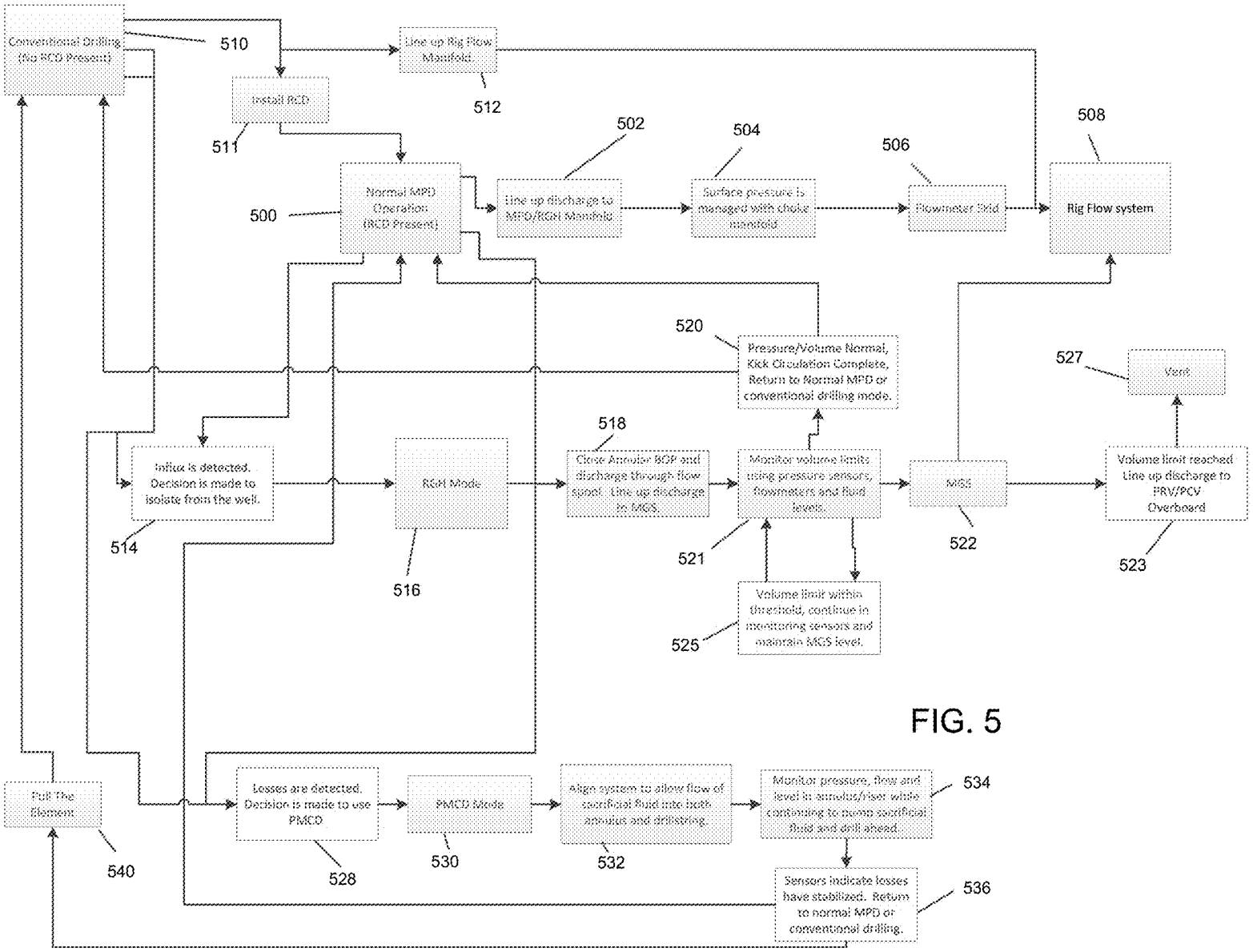
FIG. 5 shows a flow chart of an example embodiment of a method according to the present disclosure.

In FIG. 5, well fluid flow and pressure control components explained with reference to FIG. 4 are shown schematically in the block labeled MPD/RGH system 500. The MPD/RGH system in some embodiments may include all the components shown in FIG. 4. In some embodiments, managed pressure drilling may not be used, as shown in FIG. 5 at 510. In such embodiments, the RCD (402 in FIG. 4) may be omitted and returned drilling fluid flow from a well may pass through a suitable manifold, which is set up at 512 in FIG. 5, ultimately to be returned to the drilling fluid flow system (including, e.g., processing components as shown in FIG. 1 or FIG. 2) disposed proximate the drilling unit (100 in FIG. 1). Fluid returned from a well is shown as being returned to the drilling unit fluid flow system at 508. Handling of the returned fluid from the well may be performed as explained with reference to FIGS. 1, 2 and/or 3.

When the drilling system operator decides to use managed pressure drilling, an RCD and fluid outlet components may be assembled onto the well, as shown at 511, as explained with reference to FIGS. 1 and/or 2. When such assembly is completed, the components of the MPD/RGH system shown in FIG. 4 may be present. At 500, managed pressure drilling operations may be in progress. At 500, there is no detected influx of fluid into the well or any loss of fluid from the well.

When it is determined from various sensor measurements that fluid is neither entering the well from a formation nor is drilling fluid being lost to any formation, at 500, discharge of returned fluid from the well is directed to the MPD/RGH manifold at 502, and then to the controllable orifice choke at 504 so that selected fluid pressure may be maintained in the well. Fluid leaving the controllable orifice choke (e.g., 130 in FIG. 2) may pass through a flow meter at 506 and ultimately may be returned to the drilling fluid flow system at 508.

At 514, if a fluid influx into the well is detected, for example and without limitation, measurement of an increase in flow rate of fluid being discharged from the well while the rate of pumping drilling fluid into the well is unchanged, or measurement of a position of a control that operates the controllable orifice choke as described in U.S. Pat. No. 7,562,723 issued to Reitsma. In such event, the MPD/RGH system may automatically change to "riser gas handling" (RGH) mode at 516. In RGH mode, the annular BOP (408 in FIG. 4) may be closed, at 518, and fluid flow from below the annular BOP (408 in FIG. 4) may be diverted from the riser (212 in FIG. 3) to the distribution manifold (414 in FIG. 4). Fluid flow diverted to the distribution manifold (414 in FIG. 4) may be directed to the MPD/RGH choke manifold (428 in FIG. 4) wherein at 521 pressure and volume of the fluid flowing through the MPD/RGH choke manifold (428 in FIG. 4) may be measured. Gas that may be present in the returned fluid from the well may be separated from the returned fluid through the mud gas separator at 522. Drilling fluid having gas removed therefrom may be returned to the drilling fluid flow system at 508. In some embodiments, the returned drilling fluid may pass through the flow meter 506. Measurements from the flow meter 506 may be used by the controller in the control system skid (422 in FIG. 4) to enable automatic determination of when the fluid influx has been stopped. In such event, at 520, the controller (not shown separately) in the control system skid (422 in FIG. 4) may cause the MPD/RGH system to return to MPD drilling mode. As long as the measured volume of fluid entering the well is maintained within a selected threshold, at 525, the drilling system may remain in RGH mode until the influx has stopped, at 520, or RGH mode may be maintained if the influx has not stopped.

If the fluid influx continues, at 521, returned drilling fluid may continue to be processed through the mud gas separator, at 522. Drilling fluid that has had gas removed therefrom may be returned to the fluid flow system at 508.

At 523, the volume of gas that is extracted from the returned fluid is monitored. If the gas volume remains below a selected volume limit, drilling in RGH mode may continue. If the selected volume limit is exceeded, at 523, excess gas may be vented at 527 or otherwise disposed of (e.g., by flaring). The well fluid flow system may remain in RGH mode (return to 516 in FIG. 5) until the return fluid flow rate drops below a selected threshold. In such event, the MPD/RGH system may then automatically return to MPD drilling mode at 520. In other embodiments, the drilling system operator may reconfigure the drilling system to continue drilling conventionally, that is, with no RCD or equivalent device present on the well.

If measurements of fluid flow into the well and fluid flow out of the well indicate that drilling fluid is being lost into a subsurface formation, at 528, the MPD/RGH system (e.g., as determined in the control system skid (422 in FIG. 4) may automatically convert to pressurized mudcap drilling (PMCD) mode at 530. One example embodiment of detecting drilling fluid losses into a subsurface formation is described in U.S. Pat. No. 7,562,723 issued to Reitsma. Other methods for detecting fluid loss using measurements of fluid flow into the well compared with measurements of fluid flow out of the well are known in the art. In some embodiments, fluid influx into the well and fluid loss to a formation in the well may be determined using measurements of flow rate of fluid into the well, for example and without limitation using a flow meter or a "stroke counter" functionally coupled to the rig mud pumps (138 in FIG. 1). When the MPD/RGH system is in PMCD mode, at 532, the annular BOP (408 in FIG. 4) may be closed and a sacrificial fluid may be pumped into the drill string. A sacrificial fluid is a fluid that may be lost economically to one or more formations while maintaining hydrostatic pressure in the well to prevent fluid entry into the well from other formations having higher pore fluid pressure. The sacrificial fluid may contain additives to enhance the capability of the sacrificial fluid to seal formations into which fluid enters from the well. At 534, pressure and fluid level in the riser (212 in FIG. 3) may be measured at 534. When measurements of pressure and fluid level in the riser indicate that fluid loss has been abated, at 536, the MPD/RGH system may automatically return to MPD mode. In other embodiments, the drilling system operator may choose to reconfigure the drilling system to continue drilling conventionally, that is, by removing the RCD at 540 and continuing drilling with no RCD or equivalent device present on the well.

A system and method according to the present disclosure may provide more effective and rapid control over fluid influx and fluid loss events during well drilling.

While the disclosure has been described with respect to a limited number of embodiments, those skilled in the art, having benefit of this disclosure, will appreciate that other embodiments can be devised which do not depart from the scope of what has been described herein. Accordingly, the scope of the disclosure should be limited only by the attached claims.

What is claimed is:

1. An apparatus, comprising:

an annular blowout preventer disposed in a riser between a subsea wellhead and a drilling platform, wherein the subsea wellhead is coupled to a top of a subsea well that is provided at a water bottom;

a subsea blowout preventer assembly stack connected to the subsea wellhead, provided proximate the water bottom, and disposed below the annular blowout preventer, wherein the subsea blowout preventer assembly stack is separate and distinct from the annular blowout preventer;

a pump provided adjacent to the subsea wellhead, wherein the pump is fluidly connected to the riser via a valve that is connected to a riser section of the riser adjacent to the subsea wellhead, wherein an inlet pressure to the pump is selected by a drilling unit, and the riser extends to the drilling unit;

a first manifold in fluid communication with the subsea well;

a choke in fluid communication with the first manifold;

a second manifold in fluid communication with the annular blowout preventer;

a choke manifold in fluid communication with the second manifold; and a flow meter in fluid communication with the choke manifold and configured to determine an amount of fluid influx from a formation through which the subsea well extends, an amount of fluid loss into the formation, or both;

wherein, when the flow meter determines that the amount of fluid influx is less than a first predetermined threshold and the amount of fluid loss is less than a second predetermined threshold, then the fluid from the subsea well is directed to the first manifold and then to the choke to maintain a predetermined fluid pressure in the subsea well;

wherein, when the flow meter determines that the amount of fluid influx is greater than the first predetermined threshold, then the annular blowout preventer is closed, the fluid below the annular blowout preventer is diverted from the riser to the second manifold and then to the choke manifold; and wherein, when the flow meter determines that the amount of fluid loss is greater than the second predetermined threshold, then the annular blowout preventer is closed, and a sacrificial fluid is pumped into a drill string in the subsea well, wherein the sacrificial fluid comprises additives that seal cracks in the formation.

2. The apparatus of claim 1, wherein the choke comprises a controllable orifice choke in a fluid discharge path from the subsea well.

3. The apparatus of claim 1, further comprising a rotating control device positioned such that at least a portion of the riser is located between the rotating control device and a drilling fluid flow system disposed on the drilling platform.

4. The apparatus of claim 1, wherein the flow meter is located in a fluid outlet path from the subsea well.

5. The apparatus of claim 1, wherein the annular blowout preventer is configured to be closed if either the fluid influx into the subsea well is detected or the fluid loss into the formation is detected.

6. The apparatus of claim 1, further comprising a riser gas handler associated with the annular blowout preventer, wherein the riser gas handler is configured to divert fluid to the second manifold.

7. The apparatus of claim 1, further comprising a source of the sacrificial fluid, wherein the sacrificial fluid is pumpable from the source into the subsea well below the annular blowout preventer.

8. The apparatus of claim 1, further comprising a pressure transducer forming part of a measurement while drilling/logging sensor suite.

9. A method, comprising: pumping fluid of a drilling unit into a drill string extending through a riser into a well;

detecting a fluid influx into the well or a fluid loss into a formation;

abating the fluid influx by closing an annular blowout preventer disposed in the riser and diverting the fluid flowing through a flow spool below the annular blowout preventer from the riser to a distribution manifold and then to a choke manifold;

abating the fluid loss by closing the annular blowout preventer and pumping a sacrificial fluid into the drill string using a pump that is located adjacent to the well by lifting fluid from a base of the riser, wherein the pump is in fluid communication with the riser at the base of the riser;

maintaining a predetermined fluid pressure in the well when neither the fluid influx nor the fluid loss is detected by directing the fluid from the well to a manifold and then to a choke;

coupling the flow spool to the annular blowout preventer such that the annular blowout preventer is disposed above the flow spool; and connecting a blowout preventer assembly stack to a wellhead of the well such that the blowout preventer assembly stack is disposed below the flow spool.

10. The method of claim 9, wherein the fluid influx and the fluid loss are detected by measurements from one or more flow meters in a fluid return path from the well.

11. The method of claim 9, wherein the abating the fluid influx by closing the annular blowout preventer comprises automatically switching to a riser gas handling mode.

12. The method of claim 9, wherein abating the fluid influx comprises diverting gas entering the well around the annular blowout preventer.

13. The method of claim 9, wherein the sacrificial fluid is pumped into the well below the annular blowout preventer while the annular blowout preventer is closed.

14. The method of claim 9, wherein the predetermined fluid pressure is maintained in the well by operating a controllable orifice of the choke, wherein the choke is located in a fluid return path from the well.

15. The method of claim 9, wherein the fluid influx or fluid loss is detected by determining a position of a controllable orifice of the choke.

16. The method of claim 9, wherein detecting the fluid influx or fluid loss is determined using measurements of fluid pressure in the well and measurements of fluid flow rate into the well.

17. The method of claim 9, wherein measurements of pressure in the wellbore are made by a pressure transducer forming part of a measurement while drilling/logging sensor suite.

18. An apparatus, comprising:

a drilling unit comprising a derrick and hoisting equipment, the drilling unit comprising drilling mud pumps having a discharge in fluid communication with an interior of a drill string suspended in a well by the hoisting equipment;

a riser extending from a subsea blowout preventer assembly stack to the drilling unit, wherein the subsea blowout preventer assembly stack is coupled to a top of the well;

a pump in fluid communication with the riser at a base of the riser adjacent the top of the well, wherein an inlet pressure to the pump is selected by the drilling unit;

an annular blowout preventer disposed between the subsea blowout preventer assembly stack and the riser, the annular blowout preventer having a controllable flow bypass;

a flow spool separating the subsea blowout preventer assembly stack and the annular blowout preventer such that the annular blowout preventer is disposed above the flow spool, and the subsea blowout preventer assembly stack is disposed below the flow spool;

a managed pressure drilling system disposed proximate the drilling unit and comprising a controllable orifice choke in a fluid discharge path from the well, wherein the pump is in fluid communication with the managed pressure drilling system via the fluid discharge path;

a first manifold in fluid communication with the well and the controllable orifice choke;

a second manifold in fluid communication with the annular blowout preventer;

a choke manifold in fluid communication with the second manifold; and a flow meter in fluid communication with the choke manifold and configured to determine an amount of fluid influx from a formation, an amount of fluid lost into the formation, or both;

wherein, when the flow meter determines that the amount of fluid influx is less than a first predetermined threshold and the amount of fluid lost is less than a second predetermined threshold, then the fluid from the well is directed to the first manifold and then to the controllable orifice choke to maintain a predetermined fluid pressure in the well;

wherein, when the flow meter determines that the amount of fluid influx is greater than the first predetermined threshold, then the annular blowout preventer is closed, the fluid flowing through the flow spool below the annular blowout preventer is diverted from the riser to the second manifold and then to the choke manifold; and wherein, when the flow meter determines that the amount of fluid lost is greater than the second predetermined threshold, then the annular blowout preventer is closed, and a sacrificial fluid is pumped into the drill string, wherein the sacrificial fluid comprises additives that seal cracks in the formation.

* * * * *